US007299807B2

(12) United States Patent
Spatafora et al.

(10) Patent No.: US 7,299,807 B2
(45) Date of Patent: Nov. 27, 2007

(54) MACHINE FOR CONDITIONING CIGARS

(75) Inventors: Mario Spatafora, Bologna (IT); Bruno Tommasini, Bologna (IT)

(73) Assignee: G.D. S.p.A., Bologna (IT)

( * ) Notice: Subject to any disclaimer, the term of this patent is extended or adjusted under 35 U.S.C. 154(b) by 453 days.

(21) Appl. No.: 10/626,720

(22) Filed: Jul. 25, 2003

(65) Prior Publication Data

US 2005/0087201 A1 Apr. 28, 2005

(30) Foreign Application Priority Data

Aug. 8, 2002 (IT) ..... BO2002A0528

(51) Int. Cl.
*A24F 13/34* (2006.01)
*A24D 1/00* (2006.01)

(52) U.S. Cl. ..... 131/253; 131/254; 131/255

(58) Field of Classification Search ..... 131/253–255, 131/283, 290, 79

See application file for complete search history.

(56) References Cited

U.S. PATENT DOCUMENTS 2,277,690 A 3/1942 Clausen
2,754,830 A * 7/1956 Noecker et al. ..... 131/254
2,800,133 A 7/1957 Sundberg

* cited by examiner

*Primary Examiner*—Carlos Lopez
(74) *Attorney, Agent, or Firm*—Timothy J. Klima

(57) ABSTRACT

Cigars are released from a feed station onto first and second conveyor belts and directed along a predetermined feed path, part of which coinciding with a wheel interposed between the two belts and equipped with a set of needles serving to pierce the cigars by engaging at least one respective end portion; the wheel is also equipped with a set of clamp elements, each able to restrain a single cigar and caused to revolve in stable alignment with a relative needle. The single needle is fashioned from a resistive metal and connected to an electrical power source in such a way that it can be heated by applying a current and inducing the Joule effect.

21 Claims, 6 Drawing Sheets

MACHINE FOR CONDITIONING CIGARS

BACKGROUND OF THE INVENTION

The present invention relates to a machine for conditioning cigars, of which the characterizing features are as recited in the preamble of claim 1 appended.

The invention finds application in the art field of making and packaging cigars.

Before smoking a cigar, it is normal to pierce one end longitudinally so that the smoke can be drawn easily into the mouth when the cigar is lit.

To accomplish this operation, use has always been made of manual punch devices typically comprising a tubular body in which to locate the end of a single cigar, and a punch positioned to pierce the cigar when offered to the tubular body.

With the advent of mechanization and its impact on the manufacture of tobacco products generally, this piercing operation is now included among the functions of normal cigar making machines.

In effect, the prior art embraces piercing units that consist in heads equipped with a plurality of needles positioned so as to engage a corresponding plurality of cigars disposed parallel one with another and arranged in an ordered succession.

More exactly, ordered groups of cigars advancing through the machine are directed into a piercing station and thereupon held stationary so that they can be engaged by the aforementioned heads carrying the needles.

The needles are heated so that the tobacco can be subjected to what is in effect a stretching action, designed to ensure that the hole retains its shape rather than closing up once the needle has been withdrawn.

For this heat-stretching action to be effective, clearly enough, the needle must remain in the hole for a certain period of time.

Consequently, the feed unit by which the cigars are advanced must pause for a duration at least equal to the period of time in question.

Conventional machines thus betray the drawback of requiring lengthy cycle times, and this has obvious repercussions on the operating efficiency and the profitability of such machines.

Another drawback connected with the use of prior art machines is that, in seeking to avoid further prolongation of the pause, attempts have been made to speed up the steps of inserting and withdrawing the needle into and from the cigar; this expedient has negative consequences however, since the cigars can suffer damage from the substantially impulsive action of the needle.

Furthermore, the needles will be heated typically by thermal conduction, utilizing a heating element carrying electric current, which is positioned to engage each needle directly and supplied with power by way of sliding contacts.

Because the heating step occurs with the passage of heat between an electrically warmed body and the needle, monitoring the temperature of the needle is somewhat problematical. In particular, considerable difficulty is experienced in seeking to regulate the temperature of the needle according to the time it dwells in the cigar, to the operating speed of the machine, also to the ambient temperature, with the end in view of obtaining a product such as will respond accurately and repeatably to a required set of characteristics.

The object of the present invention is to provide a machine for conditioning cigars such as will be affected neither generally nor even in part by the drawbacks mentioned above, remaining nonetheless functional and economical to operate.

SUMMARY OF THE INVENTION

The stated objects and others besides, which will emerge more clearly in the course of the following specification, are realized ultimately in a machine according to the invention for conditioning cigars, comprising at least one distribution station from which cigars are taken up by conveyor means and directed along a predetermined feed path; also piercing means operating along the feed path and designed to penetrate at least one respective end portion presented by each cigar. To advantage, the piercing means consist in resistive elements such as can be heated directly by the Joule effect.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
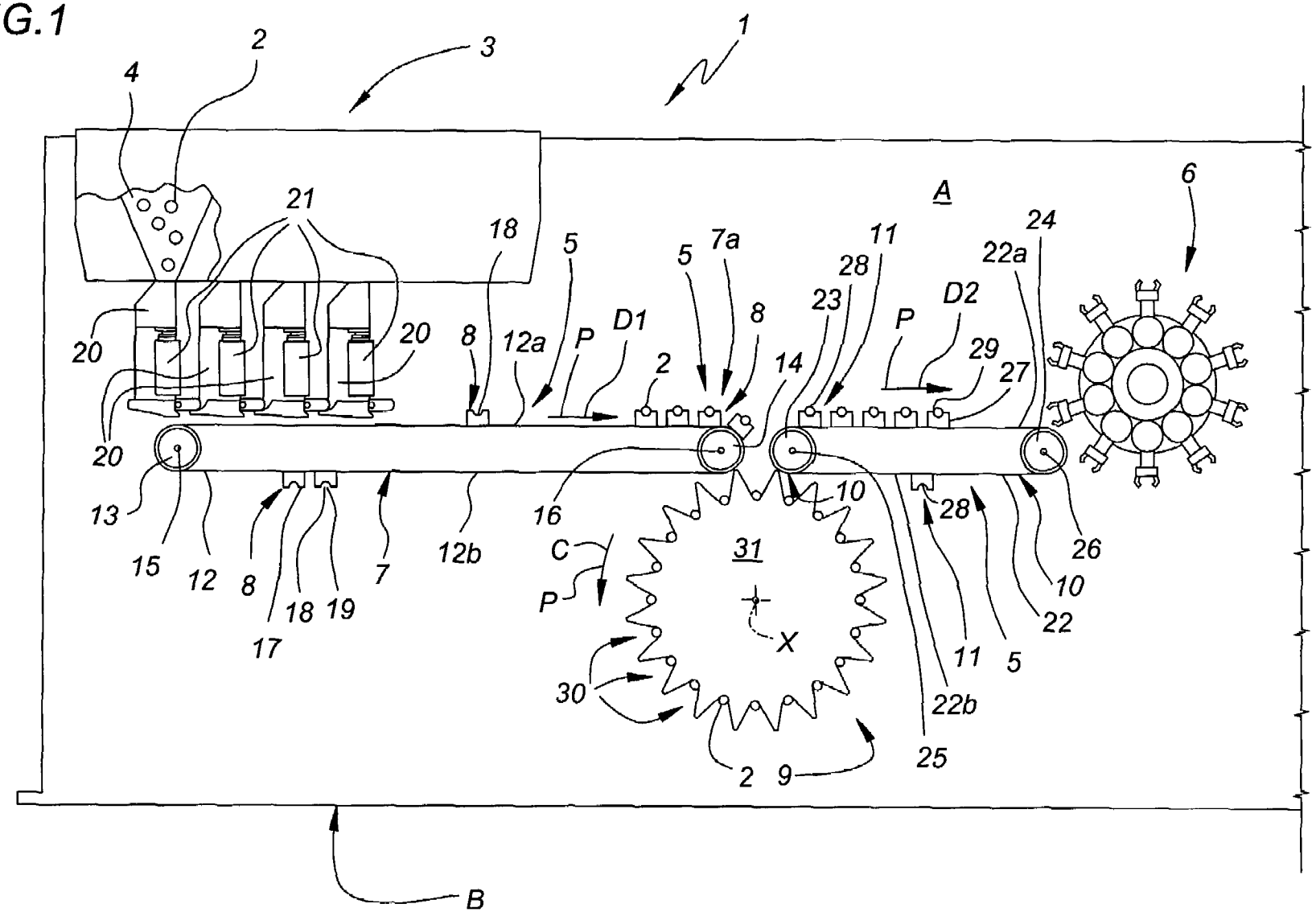
FIG. 1 shows a portion of a cigar making machine embodied in accordance with the present invention, illustrated in a schematic elevation view.

Referring to FIG. 1 of the drawings, 1 denotes a portion of a machine for manufacturing cigars 2, comprising a frame B, and a vertical bulkhead A supported by the frame.

The machine 1 also comprises a temporary storage and distribution station 3 carried by the vertical bulkhead A, where the cigars 2 are directed singly and in succession from a hopper 4, forming part of the station 3, onto conveyor means denoted 5. Such conveyor means 5 serve to transfer the cigars 2 in continuous motion along a predetermined feed path P toward a treatment station 6 of conventional type, illustrated only in part in FIG. 1.

The conveyor means 5 preferably include a first conveyor belt 7 equipped with a first plurality of cradle elements 8 by which the cigars 2 are carried from the distribution station 3 along a direction denoted D1 toward a conveyor device 9, and a second conveyor belt 10 equipped with a second plurality of cradle elements 11 carrying the cigars 2 along a direction denoted D2, from the conveyor device 9 toward the treatment station 6.

In detail, the first conveyor belt 7 comprises a belt loop 12 passing around two pulleys 13 and 14 carried by the vertical bulkhead A. The pulleys are rotatable about respective axes 15 and 16 disposed parallel one with another and perpendicular to the viewing plane of FIG. 1.

The first cradle elements 8 are carried by the belt loop 12, equispaced at a predetermined pitch along the outer surface of the loop.

Each cradle element 8 is embodied as a block 17 fashioned with a groove 18 extending parallel to the axes 15 and 16 of the pulleys. The groove 18 presented by the block 17 of an individual cradle element 8 establishes a respective pocket 19 in which to accommodate a respective cigar 2, disposed with its longitudinal axis extending parallel to the aforementioned axes 15 and 16 of rotation and transversely to the conveying direction D1.

The belt loop 12 affords an active top branch 12*a* by which the blocks 17 are carried along the feed path P, and a bottom branch 12*b* by which the blocks are carried back toward the temporary storage and distribution station 3.

The temporary storage and distribution station 3 is conventional in embodiment, and therefore not described in detail, but will in any event comprise a plurality of substantially vertical channels 20 and relative transfer mechanisms 21 by which the cigars 2 are released in ordered succession to the pockets 19 of the first conveyor belt 7.

In like manner to the first conveyor belt, the second conveyor belt 10 comprises a belt loop 22 passing around two pulleys 23 and 24 carried by the vertical bulkhead A and rotatable about respective axes 25 and 26 disposed parallel to the axes 15 and 16 of the pulleys 13 and 14 associated with the first conveyor belt 7.

The aforementioned second cradle elements 11 are carried by the belt loop 22, distributed uniformly at a predetermined pitch along the outer surface of the loop.

Each of the second cradle elements 11 appears as a block 27 fashioned with a groove 28 extending parallel to the axes 25 and 26 of the pulleys. The groove 28 presented by the block 27 of a single cradle element 11 creates a respective pocket 29 in which to accommodate a relative cigar 2, disposed with its longitudinal axis extending parallel to the aforementioned axes 25 and 26 of rotation and transversely to the conveying direction D2.

The belt loop 22 affords an active top branch 22*a* by which the blocks 27 are advanced along the feed path P, and a bottom branch 22*b* by which the blocks are carried back toward the conveyor device 9.

Figure 2:
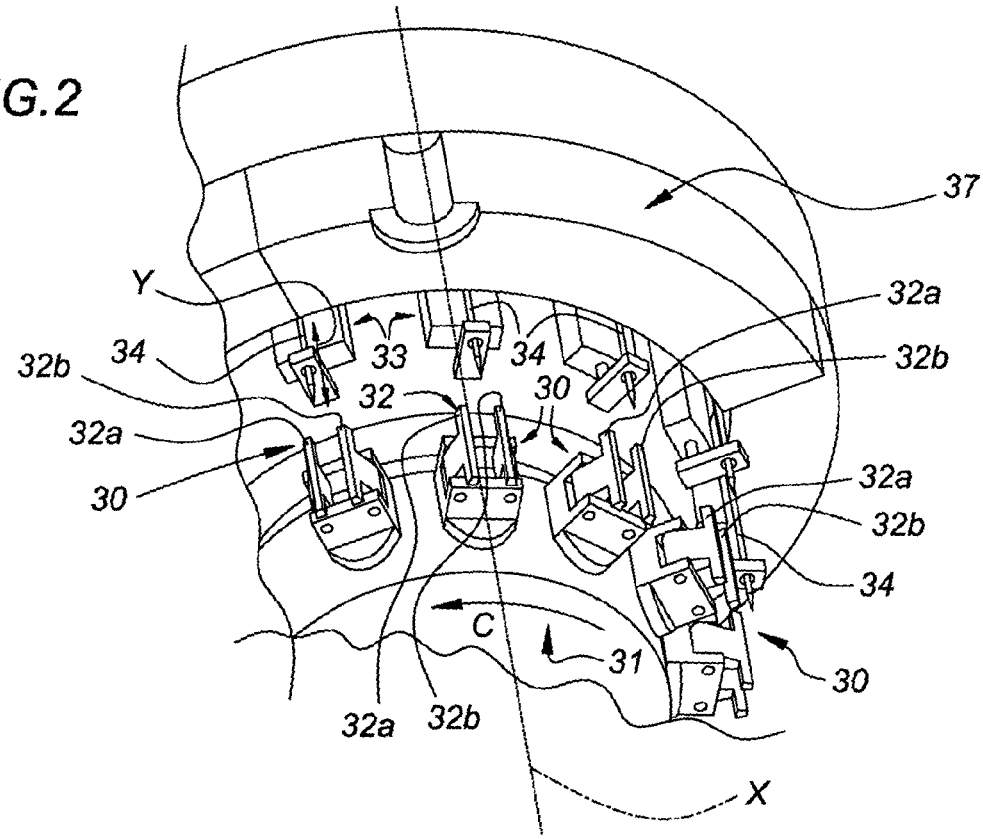
FIG. 2 shows an enlarged detail of the machine in FIG. 1, illustrated in perspective.

As illustrated in FIGS. 1 and 2, the conveyor device 9 occupies a position between the first conveyor belt 7 and the second conveyor belt 10 and comprises a plurality of clamp elements 30 capable of movement along the feed path P, of which the function is to restrain the cigars 2.

To advantage, the conveyor device 9 establishes a circular feed path C forming a part of the overall feed path P and running below the level of the two conveyor belts 7 and 10, in a plane parallel to the vertical bulkhead A of the machine 1.

In particular, one end 7*a* of the first conveyor belt 7 lying downstream of the temporary storage and distribution station 3, considered in relation to the direction D1 followed by the cigars 2, is positioned close to the conveyor device 9 in such a way that each successive cigar 2 reaching the end of the conveyor belt 7 will be transferred to and retained by one of the clamp elements 30 of the conveyor device 9.

Similarly, one end 10*a* of the second conveyor belt 10 lies close to the conveyor device 9, facing the aforementioned end 7*a* of the first conveyor belt 7, and is positioned to take up the cigars 2 from the conveyor device 9.

Referring to FIGS. 1, 2, 3 and 9, the conveyor device 9 is embodied advantageously as a wheel 31 rotatable about a relative center axis X parallel to the axes 15, 16, 25 and 26 of the pulleys 13, 14, 23 and 24. The clamp elements 30 consist in a plurality of grippers 32, each equipped with two jaws 32*a* and 32*b* and arranged around the periphery of the wheel 31, such as can be caused by suitable mechanisms of familiar type (not illustrated) to alternate between an open position and a closed position.

The grippers 32 open and close according to the angular position assumed by the wheel 31, and in such a way that the single cigar 2 can be held in a position with its longitudinal axis parallel to the axis of rotation X of the wheel 31. In practice, the grippers 32 will be open when passing close to the first and second conveyor belts 7 and 10, so as to pick up and release the cigars, respectively.

Figure 3:
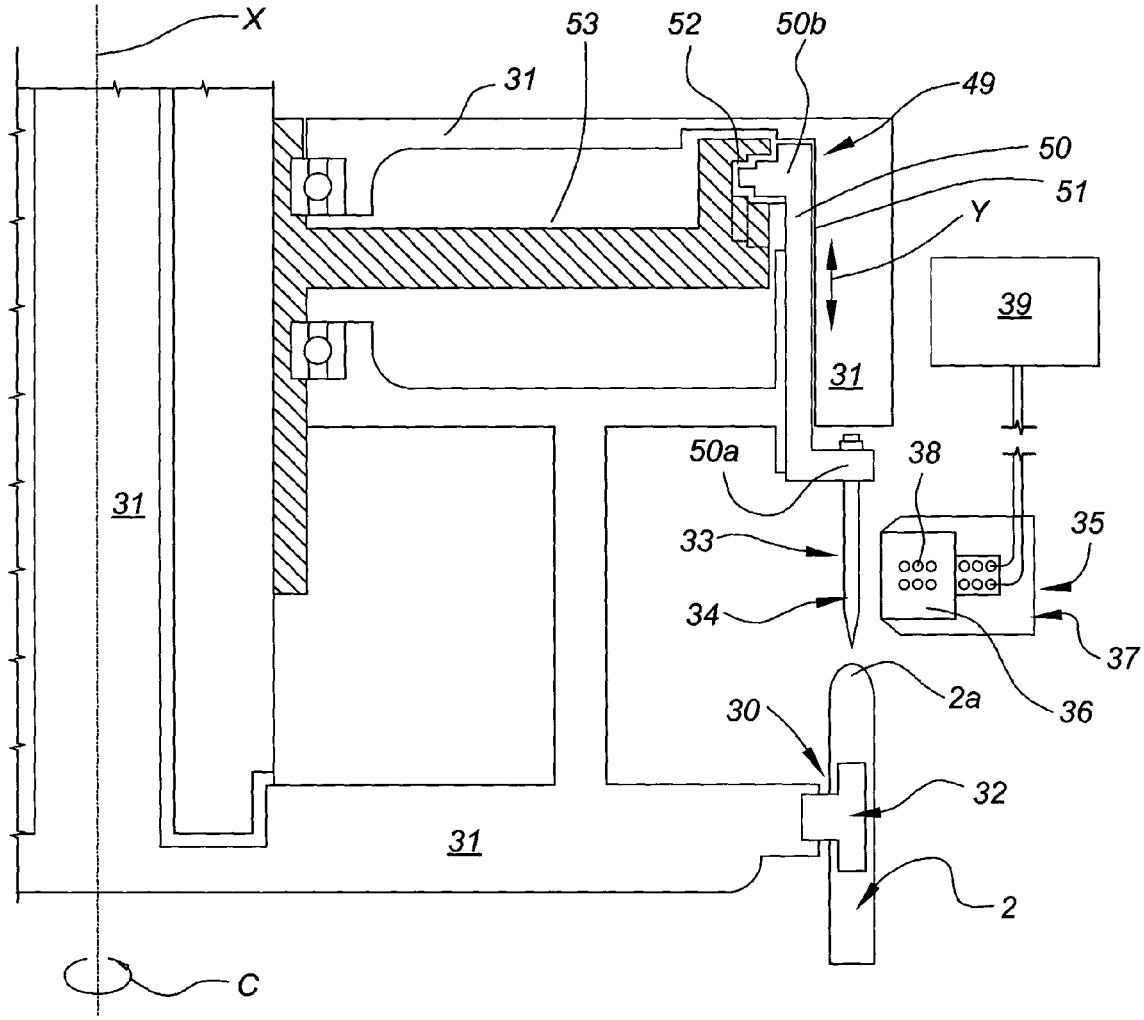
FIG. 3 shows the detail of FIG. 2 in a part plan and part sectional view, illustrating a first embodiment of a piercing device according to the present invention.

The machine 1 according to the invention also comprises piercing means 33 operating along the feed path P, and more exactly in conjunction with the conveyor device 9, of which the function is to pierce each successive cigar 2 by penetrating at least one respective end portion 2*a* (FIG. 3).

In the various examples illustrated, the piercing means 33 comprise a plurality of needles 34, each positioned in alignment with one clamp element 30 of the conveyor device 9.

Each needle 34 is capable of movement along the feed path P together with the corresponding clamp element 30, and is capable also of axial movement in a direction Y transverse to the feed path P followed by the cigars 2, between a position of proximity to the clamp element 30 and a position distanced from the clamp element 30.

In the examples illustrated, each needle 34 is capable of movement along the circular feed path C established by the wheel 31, together with the relative clamp element 30.

As the needle 34 moves toward the relative clamp element 30, it will pierce the cigar 2 restrained by the selfsame clamp element 30, penetrating the end portion 2*a* axially as the cigar 2, needle 34 and clamp element 30 all advance as one along the feed path C.

The machine 1 also comprises means 35 by which to heat the needles 34. Such heating means 35 serve to maintain the needle 34 at a temperature that will enable it to pierce the cigar 2 cleanly, and at the same time apply a stretching action to the tobacco, designed to maintain the patency of the hole after the needle 34 has been withdrawn.

Advantageously, the single needle 34 is fashioned from a ferrous material with high resistivity and heated by causing an electric current to pass along it, so that an increase in temperature is brought about by the Joule effect.

Figure 4:
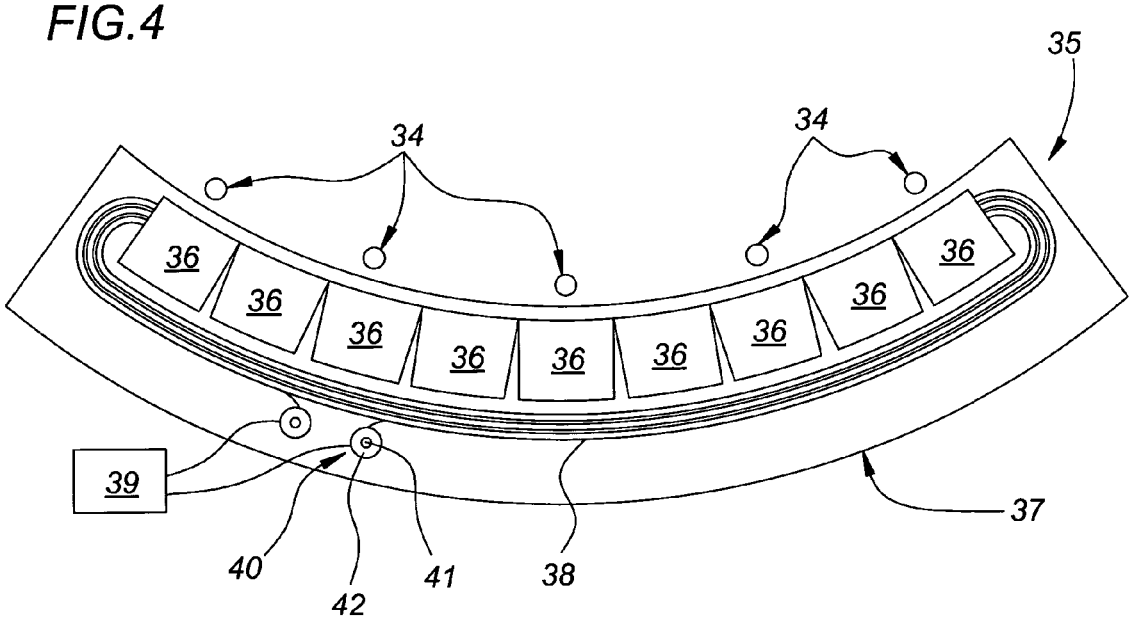
FIG. 4 shows the piercing device of FIG. 3, illustrated in a schematic elevation view.
Figure 5:
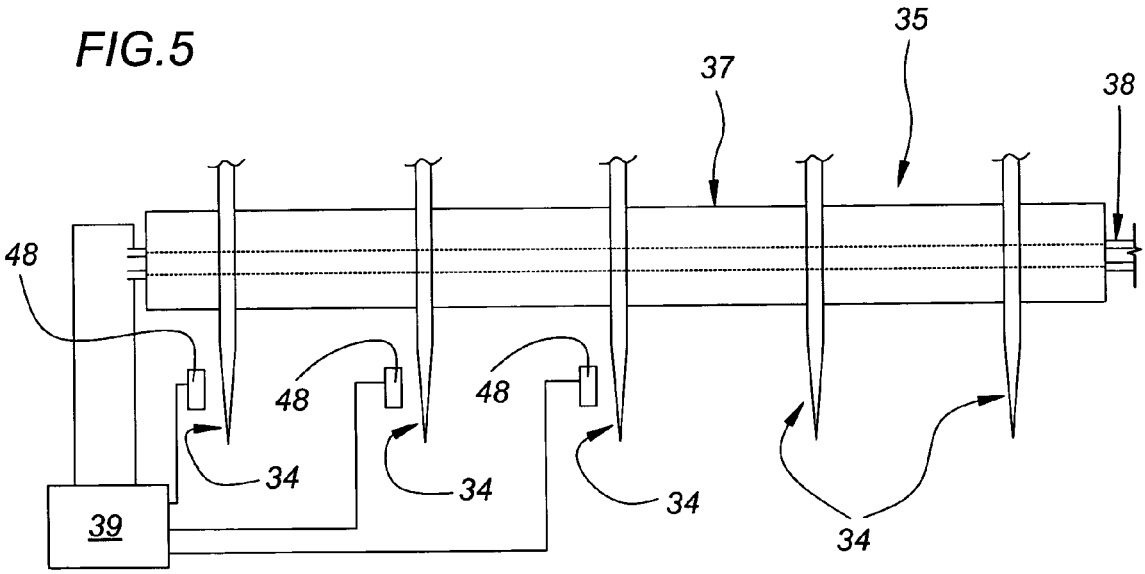
FIG. 5 shows the device of FIG. 4, illustrated schematically from above.

In a first embodiment illustrated in FIGS. 3, 4 and 5, the needles form part of an electromagnetic circuit and heat is generated by the induction of eddy currents.

The heating means 35 illustrated in FIG. 4 will be seen to comprise a fixed inductor generating magnetic fluxes and comprising a plurality of fixed ferrite cores 36 mounted to the vertical bulkhead A of the machine 1, positioned in close proximity to the needles 34.

Given that the needles 34 move along the circular feed path C, the fixed ferrite cores 36 are grouped in sectors 37 arranged on an arc to a circle and extending along the selfsame circular path C.

In this same first embodiment, the sectors 37 lie alongside the needles 34 and radially beyond the circumferential plane occupied by the needles 34.

Each sector 37 includes an electrical winding 38 passing in part through the fixed ferrite cores 36 and wired to a conventional source of electrical energy, not illustrated, by way of a control unit denoted 39 (FIG. 3).

When alternating or direct current flows through the winding 38, a magnetic field is set up in the ferrite cores 36 and closed in the area immediately adjacent, which will be occupied momentarily by the advancing ferrous needles 34.

During the course of their passage together with respective cigars 2 along the circular feed path C, the needles 34 pass through the flux lines of the magnetic field and are exposed as a result to eddy currents that will heat the ferrous material by the Joule effect.

Given that the electromagnetic field also induces heat in the fixed ferrite cores 36, in this case undesirable heat, the machine 1 will be equipped preferably with suitable cooling means 40.

The fixed ferrite cores 36 are cooled by means 40 identifiable as a circuit 41 in which to circulate a liquid coolant R, associated with the electrical winding 38 and located internally of the sector 37.

In the first embodiment illustrated, the liquid coolant R occupies a circuit 41 incorporated into the coils of the winding 38, which are fashioned of copper tube 42.

The ends of the copper tube 42 are connected, as discernible from FIG. 4, both to the electrical power source and to a source of coolant not shown in the drawings.

Figure 6:
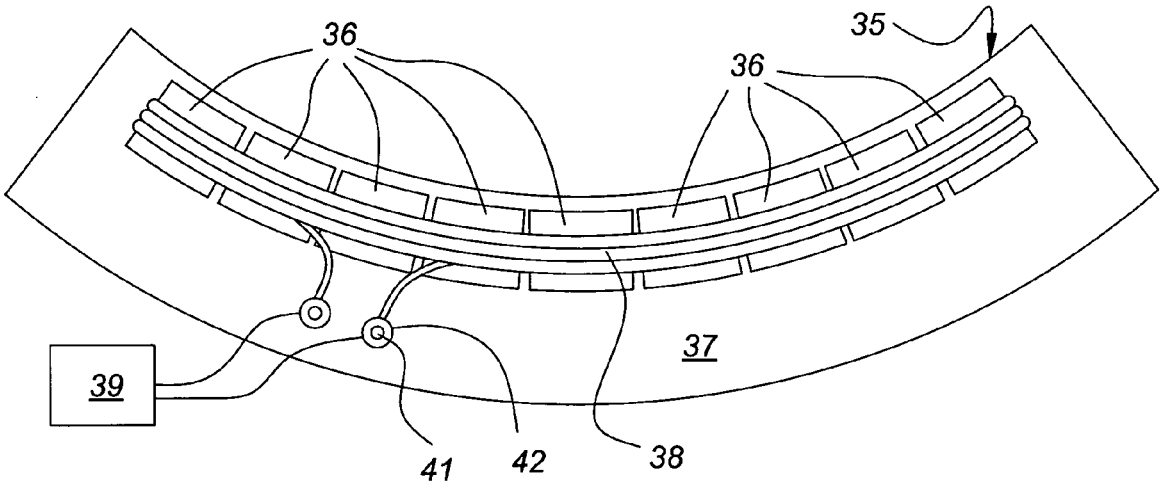
FIG. 6 shows the piercing device of FIG. 2, illustrated in a schematic elevation view and in a second embodiment according to the invention.
Figure 7:
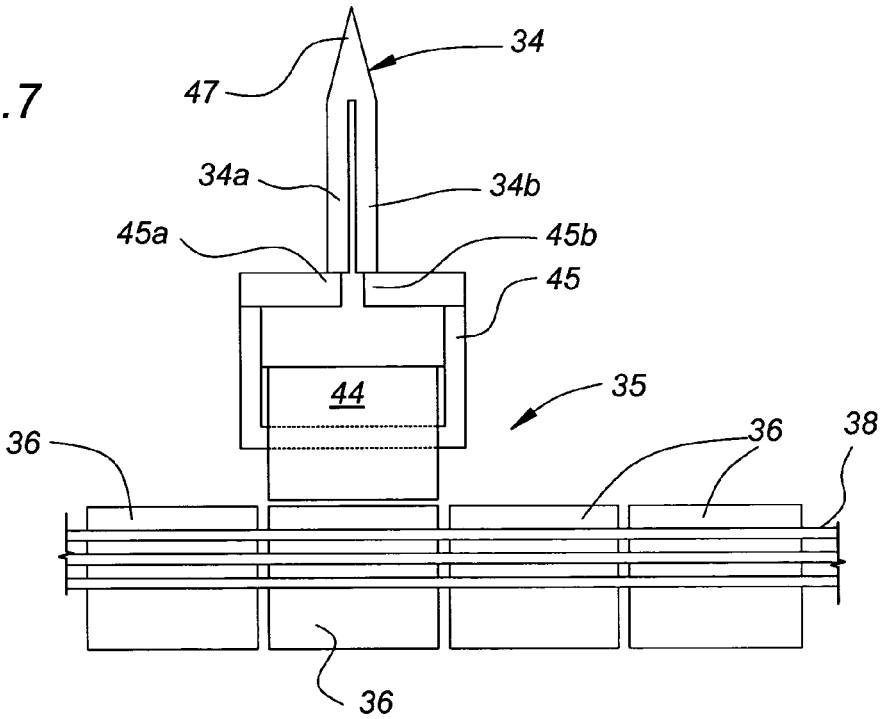
FIG. 7 shows the device of FIG. 6, illustrated schematically from above.

In a second embodiment of the present invention, shown in FIGS. 6 and 7, heat is generated by the induction of current in the secondary circuit of a transformer.

More particularly, the heating means 35 in this second embodiment comprise an inductor, functioning as a primary, which includes a plurality of fixed ferrite cores 36 positioned in close proximity to the moving needles 34 and grouped in sectors 37 arranged along an arc to a circle.

In this example, the sectors 37 are positioned behind the needles 34, as viewed in FIG. 6.

Each of the sectors 37 presents an electrical winding 38 coiled around the fixed ferrite cores 36 and wired to a conventional time-varying electrical power source, not illustrated, by way of a control unit 39. The electrical winding 38 constitutes the primary winding of a transformer.

The heating means 35 also comprise a plurality movable ferrite cores 44, each rigidly associated with a respective needle 34 and constituting an armature.

In particular, each needle 34 is connected to the respective movable ferrite core 44 by way of a coil turn 45 interposed between them. The coil turn 45 is embedded at least partly in the movable ferrite core 44 and presents two ends 45*a* and 45*b* connected to the needle 34.

In this case, accordingly, the single needle 34 forms part of an electromagnetic mutual induction circuit.

Preferably, each needle 34 presents two mutually parallel portions 34*a* and 34*b* distanced one from another and joined at a common pointed terminal portion 47; each parallel portion 34*a* and 34*b* is connected to one of the two ends 45*a* and 45*b* of the coil turn 45.

Advantageously, the coil turns 45 are fashioned from a material having a resistivity lower than that of the needles 34, and preferably copper.

The needle 34 and the relative coil turn 45 closed on the needle 34 combine thus to create a secondary winding of a transformer in which current is caused to flow when the primary, that is to say the electrical winding 38, carries a time-varying current, typically alternating current.

The induced current generates heat in the single needle 34 through the Joule effect as the cigars 2 advance along the feed path P, and in particular the circular feed path C, restrained by the clamp elements 30 and accompanied by the needles 34.

Again in this instance, the primary electrical winding 38 can be embodied conveniently as a copper tube through which a liquid coolant is circulated.

Likewise to advantage, the machine 1 comprises a plurality of temperature sensors 48 (FIG. 5) each mounted in close proximity to a relative needle 34 and connected to the control unit 39, such as will monitor the temperature of the needles in any of the embodiments illustrated.

The temperature sensing devices employed can be of a contact thermocouple type, or a non-contact type such as optical pyrometers and/or infrared thermocouples.

The output power will be regulated by the control unit 39 according to the temperature registering at the needles, and on the basis of other operating parameters monitored by way of additional sensors, such as ambient temperature, overall or localized machine temperature, operating speed, presence or absence of cigars, and so forth.

Whatever heating means 35 are adopted ultimately, the jaws 32*a* and 32*b* of the grippers 32 and the needles 34 are set in motion by suitable support and drive means 49 such as will synchronize their respective movements and impose a law of motion on the needles 34 designed to guarantee a sufficiently long dwell inside the cigars 2 during the piercing step.

Referring in particular to the part of FIG. 3 shown in section, the support and drive means 49 comprise a plurality of axially slidable shafts 50 extending parallel to the axis of rotation X of the wheel 31 and accommodated by respective sockets 51 afforded by the selfsame wheel 31.

Each shaft 50 presents a first end 50*a*, to which a needle 34 is mounted, and a second end 50*b* remote from the first end 50*a*, slidably engaging a cam 52 afforded by a fixed part 56 of the machine 1 and encircling the axis of rotation X of the wheel 31.

The cam 52 serves to establish a substantially circular path described within a plane transverse though not perfectly orthogonal to the axis of the wheel 31. Thus, the sliding motion imposed on the second end 50*b* of each shaft 50 by the profile of the cam 52, with the wheel 31 in rotation, causes the shaft 50 and the rigidly associated needle 34 to shift axially between the position of proximity to the relative clamp element 30 and the position distanced from the selfsame clamp element 30.

Figure 8:
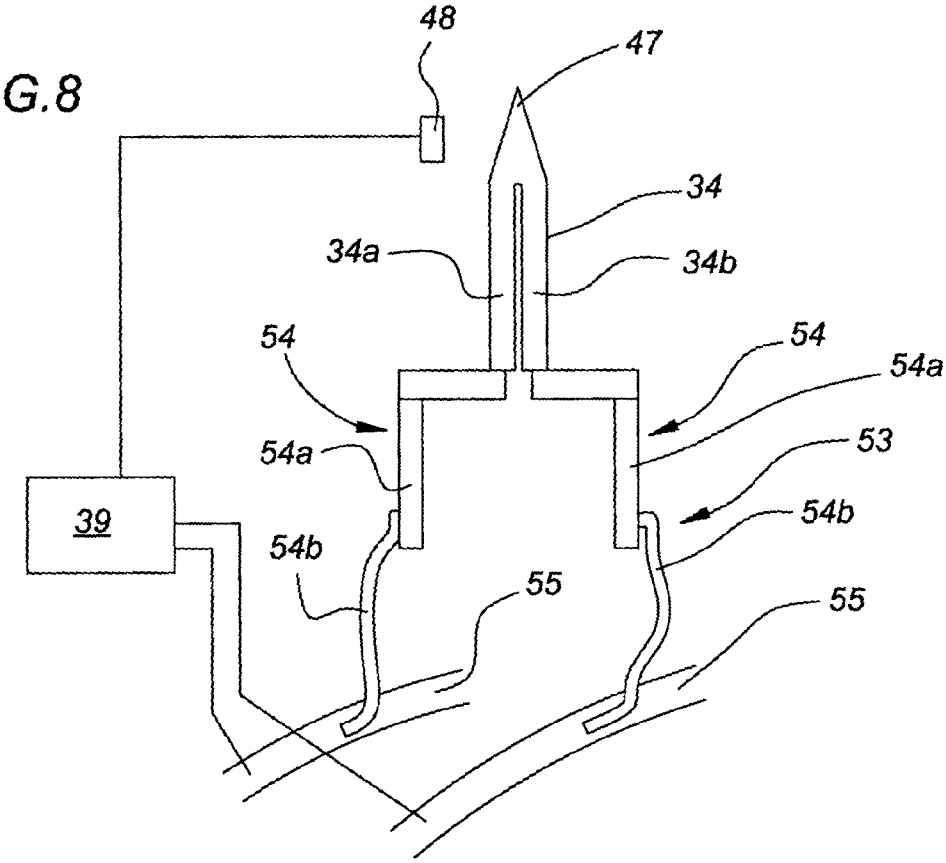
FIG. 8 shows the piercing device of FIG. 2 viewed schematically and partly as a block diagram, and illustrated in a third embodiment.
Figure 9:
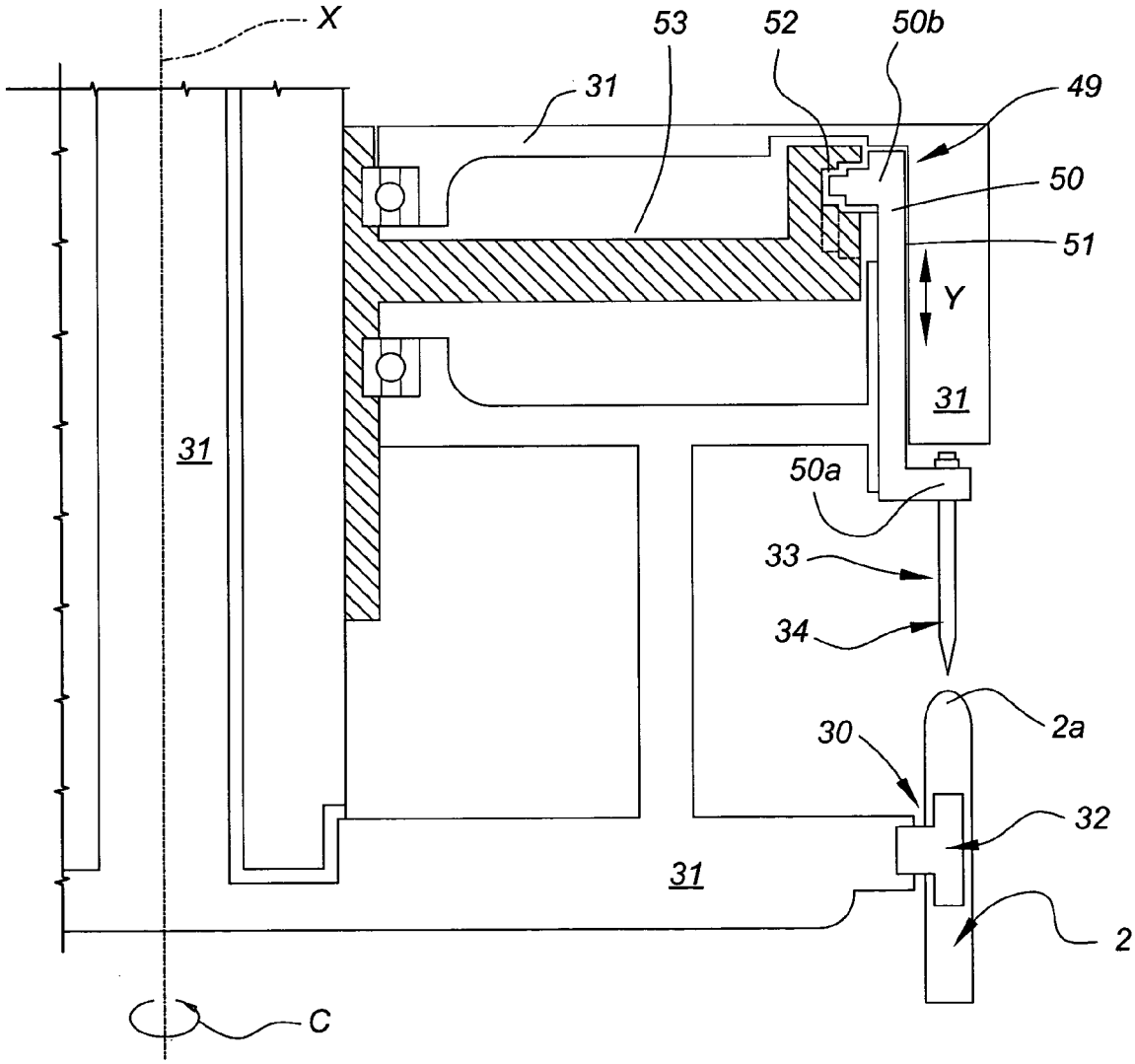
FIG. 9 shows the detail of FIG. 2 in a part plan and part sectional view, illustrating the embodiment of the piercing device as in FIG. 8.

In the example of FIGS. 8 and 9, the needles 34 are heated by applying current directly to the needle 34 itself, which is wired into an electrical circuit 53 in such a way that current flows both through the circuit and through the needle.

In particular, the single needle 34 might appear as a substantially cylindrical body with a sharp point, or alternatively, it could be of the type illustrated in FIG. 7, hence with two mutually parallel portions 34*a* and 34*b* distanced one from another and joined at a common pointed terminal portion 47.

The electrical circuit 53 associated with each needle 34 includes two electrically conductive appendages 54 embodied in a material, preferably copper, having a lower resistivity than that of the ferrous material utilized for the needle 34, each connected rigidly to a respective portion 34*a* and 34*b* of the needle 34.

The appendages 54 engage in contact respectively with two fixed conductive tracks 55, in such a way that when the wheel 31 is set in rotation about the relative axis X, they can brush permanently against the tracks 55. The two fixed conductive tracks 55 will be wired to a source of electrical energy, not illustrated, by way of the control unit 39.

More precisely, as discernible from FIG. 8, each of the two appendages 54 consists in a rigid portion 54*a*, typically a copper rod, and a flexible contact cable 54*b*.

The sliding contact between the tracks 55 and the appendages 54 causes current to pass into each of the appendages 54 and into the relative needle 34, with the result that the needle 34 is heated by the Joule effect.

As in the examples already described above, the piercing means will include temperature sensors 48, each mounted in close proximity to a respective needle 34 and connected to the control unit 39, such as will monitor the temperature of the needles however embodied and configured ultimately.

The problems associated with the prior art are overcome in accordance with the present invention, and the stated objects duly realized.

First and foremost, the machine according to the present invention allows cigars to be pierced by a continuous process, without the need to suspend other operations while piercing takes place.

In addition, by adopting the solution of a wheel and piercing means operating in conjunction with the wheel, the overall dimensions of the machine can be made more compact.

Also of significance is the fact that, with the needles heated by applying an electric current and exploiting the Joule effect, it becomes possible to limit thermal inertia and control the temperature of the single needles more easily and with greater accuracy, so as to ensure a repeatable quality of the end product.

Finally, with the combination of sensors and a control unit, as described and illustrated, the needles can be heated to a temperature and for a duration adaptable to variations detected in a range of parameters reflecting ambient conditions and operation of the machine.

What is claimed is:

1. In a cigar maker, a machine for conditioning cigars comprises:

at least one distribution station from which cigars are taken up by conveyor means and directed along a predetermined feed path;

piercing means operating along the feed path, designed to penetrate at least one respective end portion of each cigar; wherein the piercing means comprise needles fashioned from a ferrous material; wherein each needle is connected to an electrical circuit such that an electric current applied to the circuit will also pass through the needle, so that an increase in temperature is brought about by Joule effect.

2. A machine as in claim 1, wherein the needle is connected to the electrical circuit in series and comprises two mutually parallel portions distanced one from another and joined together by a pointed portion.

3. A machine as in claim 2, wherein the needles are capable of movement along the predetermined feed path and the two portions of each needle are connected by way of sliding contacts to respective conductive tracks of the electrical circuit, which are connected in turn to a source of electrical energy.

4. In a cigar maker, a machine for conditioning cigars, comprises:

at least one distribution station from which cigars are taken up by conveyor means and directed along a predetermined feed path;

piercing means operating along the feed path, designed to penetrate at least one respective end portion of each cigar and consisting in resistive elements heated directly by the Joule effect;

wherein the piercing means comprise needles fashioned from a ferrous material;

wherein each needle forms part of an electromagnetic circuit.

5. A machine as in claim 4, wherein the electro-magnetic circuit is a mutual induction circuit comprising at least one fixed inductor positioned at least along one section of the predetermined feed path, and an armature circuit associated with each needle and capable of movement along the feed path.

6. A machine as in claim 5, wherein the inductor comprises a set of first ferrite cores incorporated into an electrical winding and constituting a primary, whilst each armature circuit comprises a second ferrite core concatenated to and separated by a gap from the primary inductor, at least one coil turn constituting a secondary, wound partly about the second core and closed on a respective needle.

7. A machine as in claim 6, wherein each needle is connected in series to the coil turn and comprises two mutually parallel portions distanced one from another and joined together by a pointed portion.

8. A machine as in claim 4, wherein the electro-magnetic circuit comprises at least one fixed inductor positioned at least along one section of the predetermined feed path and generating magnetic fluxes through which the needles are caused to pass successively during their movement along the predetermined feed path.

9. A machine as in claim 8, wherein the inductor comprises a set of ferrite cores incorporated into an electrical winding connected to a source of electrical energy.

10. A machine as in claim 6, further comprising means by which to cool the fixed ferrite cores.

11. A machine as in claim 10, wherein the cooling means include a circuit, associated with the electrical winding located internally of the fixed ferrite cores, through which to direct a liquid coolant.

12. A machine as in claim 5, further comprising a control unit connected to the electrical winding and serving to regulate the power input to the selfsame winding.

13. A machine as in claim 12, further comprising a plurality of temperature sensors, each mounted close to a relative needle and able thus to detect the temperature of the selfsame needle, and connected also to the control unit in such a way as to allow of regulating the power input to the winding according to the temperature registering at the needles.

14. A machine as in claim 1, wherein the conveyor means are capable of continuous motion along the predetermined feed path.

15. A machine as in claim 14, further comprising a conveyor device forming part of the conveyor means and affording a plurality of clamp elements serving to restrain the cigars, wherein the piercing means operate in conjunction with the conveyor device.

16. A machine as in claim 15, wherein piercing means comprise a plurality of needles each positioned in alignment with one of the clamp elements of the conveyor device and capable of movement as one with the clamp element along the predetermined feed path, and capable also of axial movement in a direction transverse to the predetermined feed path followed by the cigars between a position of proximity to the relative clamp element, in which the cigar restrained by the selfsame clamp element is pierced, and a position distanced from the clamp element.

17. A machine as in claim 16, wherein the conveyor device establishes a circular feed path forming part of the predetermined feed path.

18. A machine as in claim 17, wherein the conveyor device comprises a wheel rotatable about a relative axis, carrying the clamp elements around the periphery and incorporating means by which to support and drive the needles.

19. A machine as in claim 18, wherein each clamp element presents two jaws located on the periphery of the wheel and capable of movement between an open position and a closed position.

20. A machine as in claim 18, wherein conveyor means are composed of a first conveyor belt equipped with a first plurality of cradle elements by which the cigars are carried from the distribution station to the conveyor device, and a second conveyor belt equipped with a second plurality of cradle elements by which the pierced cigars are carried from the conveyor device to a successive treatment station.

21. In a cigar maker, a machine for conditioning cigars comprises:

at least one distribution station from which cigars are taken up by conveyor means and directed along a predetermined feed path;

piercing means operating along the feed path, designed to penetrate at least one respective end portion of each cigar and consisting in resistive elements heated directly by the Joule effect;

wherein the piercing means comprise needles fashioned from a ferrous material;

wherein each needle is connected to an electrical circuit in such a way that an electric current applied to the circuit will pass also through the needle;

wherein the needle is connected to the electrical circuit in series and comprises two mutually parallel portions distanced one from another and joined together by a pointed portion.

* * * * *